US011642803B2

(12) United States Patent
ElZein et al.

(10) Patent No.: US 11,642,803 B2
(45) Date of Patent: May 9, 2023

(54) UNIVERSAL TRIMMER BLADES ADJUSTER

(71) Applicant: Hassan Mohammad Mourtada, Montreal (CA)

(72) Inventors: Ali Abed-Ali ElZein, London (GB); Hassan Mohammad Mourtada, Montreal (CA)

( * ) Notice: Subject to any disclaimer, the term of this patent is extended or adjusted under 35 U.S.C. 154(b) by 411 days.

(21) Appl. No.: 16/789,134

(22) Filed: Feb. 12, 2020

(65) Prior Publication Data

US 2020/0254637 A1 Aug. 13, 2020

Related U.S. Application Data

(60) Provisional application No. 62/804,827, filed on Feb. 13, 2019.

(51) Int. Cl.
*B26B 19/20* (2006.01)
*B26B 19/38* (2006.01)

(52) U.S. Cl.
CPC ..... *B26B 19/205* (2013.01); *B26B 19/3826* (2013.01); *B26B 19/3846* (2013.01)

(58) Field of Classification Search
CPC ..... B26B 19/3826; B26B 19/3846; B26B 19/3893; B26B 19/205; B26B 19/04
USPC ..... 33/67, 567.1, 613, 641, 645, 626, 633, 33/344, 628
See application file for complete search history.

(56) References Cited

U.S. PATENT DOCUMENTS

| | | | | |
|---|---|---|---|---|
| 4,590,677 | A * | 5/1986 | Kopp | B25H 7/04 33/42 |
| 7,290,349 | B1 * | 11/2007 | Carpenter | B26B 19/3846 30/200 |
| 9,144,913 | B2 * | 9/2015 | Gross | B26B 19/3893 |
| D903,196 | S * | 11/2020 | Carlucci | D28/54 |
| 11,104,017 | B2 * | 8/2021 | Carlucci | B26B 19/205 |
| 2012/0198716 | A1 * | 8/2012 | Tonges | B26B 19/3893 33/641 |
| 2012/0272540 | A1 * | 11/2012 | Ornelaz, Jr. | B23Q 17/0919 73/1.79 |
| 2014/0115865 | A1 * | 5/2014 | Gross | B26B 19/3893 29/281.5 |
| 2020/0376694 | A1 * | 12/2020 | Carlucci | B26B 19/205 |

* cited by examiner

*Primary Examiner* — Laura M Lee
(74) *Attorney, Agent, or Firm* — Benoit & Côté Inc.; Danny Higgins

(57) ABSTRACT

There are many trimmer models with 2 main parts, the static comb blade and the side moving cutter blade driven by electric motor/vibrator. These blades differ in many ways, shapes, sizes . . . which require fine adjustments and tenth of millimeter clearance at the end of the blades. Some models come with an adjuster that fits its model only with a fixed clearance that cannot be modified and does not fit other models. The proposed inventions are universal trimmer blades adjusters that fit most trimmer blades models and the clearance can be varied to meet the users' requirements. First invention design has one moving part with non-linear smooth adjustments and second invention design has two moving parts with linear fine adjustments.

2 Claims, 2 Drawing Sheets

UNIVERSAL TRIMMER BLADES ADJUSTER

CROSS REFERENCE TO RELATED APPLICATION

This application takes priority from and claims the benefit of U.S. Provisional Patent Application Ser. No. 62/804,827 filed on Feb. 13, 2019, the contents of which are herein incorporated by reference.

BACKGROUND OF THE INVENTION

Users and barbers use hair trimmers of different sizes and shapes. The hair trimmer has a side-movable cutter blade slides on top of a static comb blade that is in contact with skin. The top cutter end must be just behind the end of the static comb blade to avoid cutting through skin. How much behind, known as clearance, is very critical and important for barbers to ensure fine, smooth and safe shaving.

There is no trimmer blades adjuster for all models. Each trimmer model has its own adjuster that does not fit with other models. The proposed universal trimmer blade adjuster solves the problem of having many adjusters in a single universal hair trimmer blades adjuster (UTBA) with variable and high accuracy adjustments to suit all trimmer models.

BRIEF SUMMARY OF THE INVENTION

The proposed UTBA inventions are two models for the same purpose, fine adjustment of trimmer blades. The first is rotation (or inclination) plate based UTBA (RUTBA) and the second is sliding block based UTBA (SUTBA). However, both RUTBA and SUTBA use the same clamps to fasten the trimmer blades and insure their ends are in good close contact with the rotation plate and sliding block.

The first one RUTBA has a base plate and a rotating plate with both trimmer blades between the plates. The amount of rotation changes the angle between the plates and determines the amount of moving the cutter blade behind the comb blade. The narrower the angle the more the cutter blade moves behind the comb blade end, hence more clearance.

The second one SUTBA has an levelling base plate and a slider bar. The levelling plate purpose is to level the interface between the cutter and comb blades with the slider's bottom interface. Once the interfaces are leveled the slider is used to move the cutter blade behind the comb blade end, hence increasing clearance. The levelling plate and the slider bar movements are perpendicular to each other's.

Figure 1A:
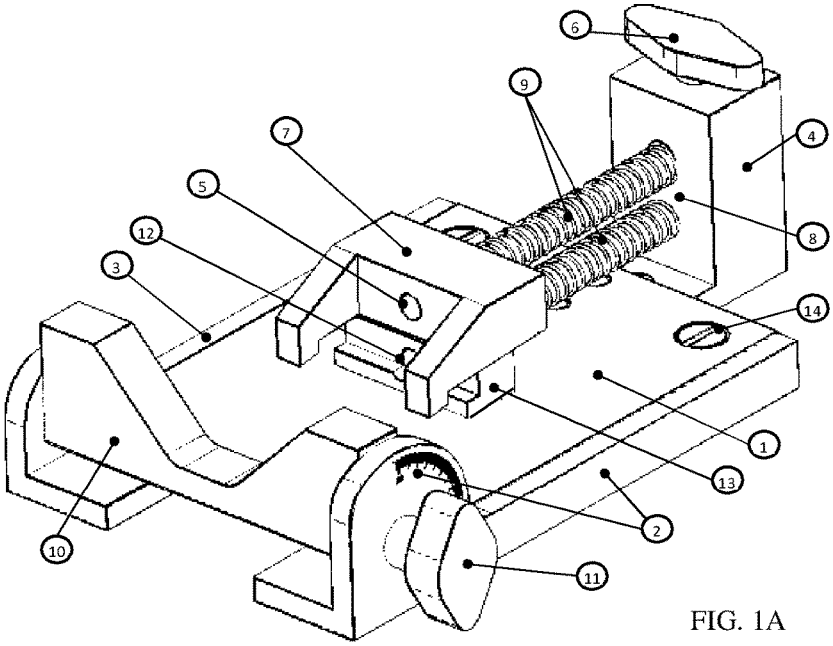
FIGS. 1A-1B show the first model RUTBA. The rotating plate on one side has a tenth of millimeter step that can be used clearance for some models.
Figure 1B:
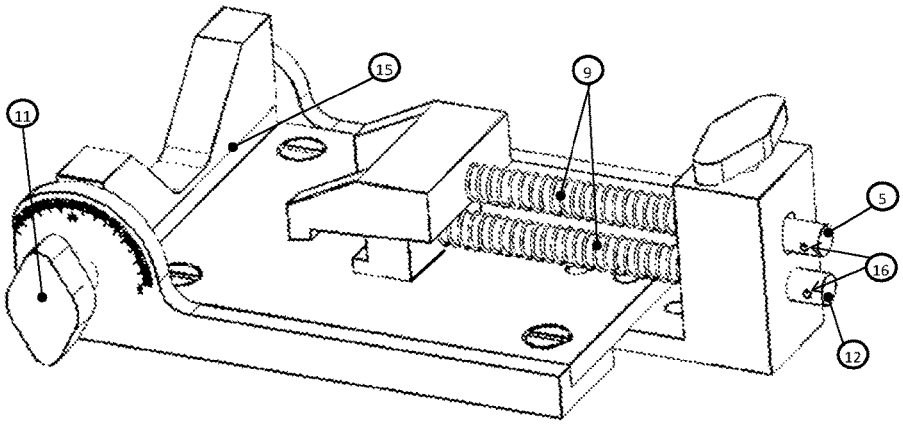
Figure 2A:
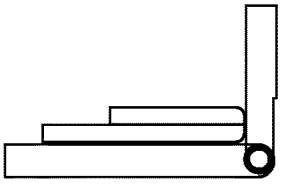
FIGS. 2A-2C illustrate the effect of rotating the plate on narrowing the angle and changing the clearance between the cutter and comb blades. It is obvious the smaller the angle between the base and rotating plates the bigger the clearance between the cutter and the comb blades. It is worth to mention that the amount of clearance in not proportional to angle value i.e. the RUTBA model is a non-linear, but very smooth and fine, blades adjuster.
Figure 2B:
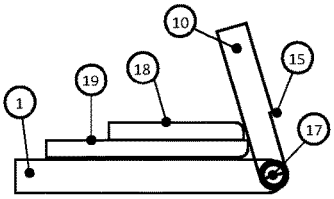
Figure 2C:
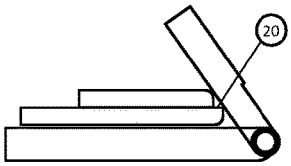
Figure 3A:
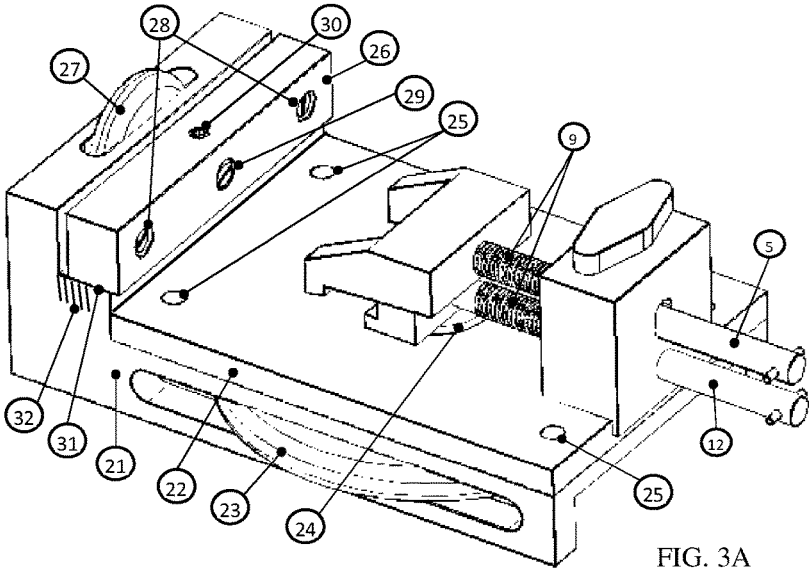
Figure 3B:
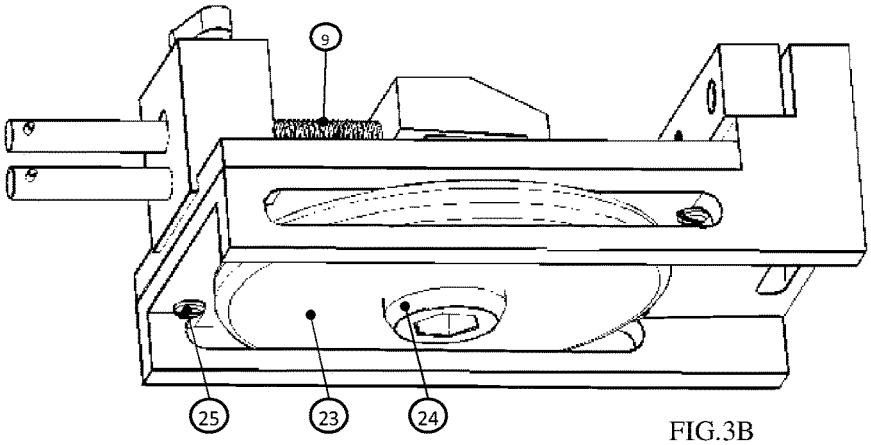

Note part (8) is a small disk, metal or hard rubber, inside the clamps holder (part 4), between the clamps rods (parts 7 & 13) and in line with the clamps screw (part 6). This disk serves to tighten the rod of the lower comb clamp at same time tightening the rod of the upper cutter clamp by the clamps wing screw (part 6). Some of comb blades (part 19) have a ridge, so the lower comb clamp (part 13) has an extension to compensate for the ridge. The clamp holder (part 4) is fastened to the base plate (part 1) by screws. Since the clamps assembly to fasten the trimmer blades has no role in blades adjustments, they are not limited to the shown design and subject to modifications. RUTBA parts are:

1—Base plate
2—Holder with angle marks
3—Holder
4—Clamps holder
5—Cutter clamp rod
6—Clamps wing screw
7—Cutter, upper, clamp
8—Disk inside clamp holder, not visible, between clamp rods
9—Top & lower Springs
10—Rotating plate
11—Rotating plate wing screw
12—Comb clamp rod
13—Comb, lower, clamp
14—Screws
15—Tenth millimeter step
16—Pin holes
17—Axis
18—Cutter blade
19—Comb blade
20—Clearance FIGS. 3A-3B show the second model SUTBA. The clamp type and parts are the same as RUTBA model and the clamp holder is fastened to levelling plate (part 22) by screws so it moves up/down with the levelling plate.

Figure 4A:
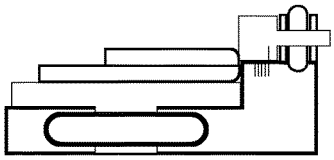
Figure 4B:
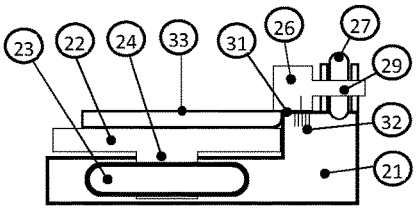
Figure 4C:
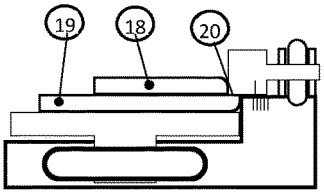

FIGS. 4A-4C are illustrations and steps for using the SUTBA model. First the comb and cutter blades (parts 19&18) are apart and slider bar is fully back. Then use the slider wheel nut (part 27) to move the slider bar (part 26) above the comb blade (part 19) and use slider interface (part 31) as reference to level the blades interface (part 33), just below the slider interface using the levelling wheel nut to move up/down the levelling plate (part 22), so the slider bar is still free to move. Finally the slider bar is moved to the required clearance (part 20) and the screws of the cutter blade's guide are tightened at that favored clearance. SUTBA parts are:

18—Cutter blade
19—Comb blade
20—Clearance
21—Body or frame
22—Levelling plate
23—Levelling wheel nut
24—Levelling screw
25—Levelling guides #4
26—Slider bar
27—Slider wheel nut
28—Slider guides #2
29—Slider screw
30—Slider screw lock
31—Slider interface
32—Markers
33—Blades interface The clamp parts in SUTBA are same as in RUTBA hence not listed with SUTBA parts. Note that parts are continued numbering to avoid mixing parts of the two models.

DETAILED DESCRIPTION AND BEST MODE OF IMPLEMENTATION

The first universal trimmer blades adjuster with rotating plate, RUTBA model, is less complicated as has only one moving part, the rotating plate. All parts must be loose, the wing-screws (parts 6 & 11) and the screws of the cutter blade's guide that is a part between the comb and cutter blades. The comb blade (part 19) sits flat on the base plate (part 1) and the cutter blade (part 18) on top of the comb blade. Both blades are hold firm to base plate and pushed towards the rotating plate by the clamps (parts 7 & 13). Usually zero clearance is not favored to avoid contact with and hurt skin. Rotating the plate towards the base plate decrease the angle between them and increases the clearance between the comb and cutter blades. The rotating plate has a V-shaped access so users can see through and determine the desired clearance, users can use a magnifier or a mobile camera for zooming. Then tighten, in order, the rotating plate and clamps wing-screws (parts 11 & 6) so the blades do not move. Through the V-shaped access users can tighten screws of the cutter blade's guide. Users can make note for the angle of rotation provided by the angle marks on holder (part 2) for reference and next time adjustment.

The amount of clearance is affected by many factors such as the thickness and the shape (round, square or trapezoidal . . . ) at the end of, mainly cutter, blades. These factors vary from model to other hence angle of adjustment is not same for all models. It is difficult to tell which rotation angle fits a certain clearance and model, only by observation for each trimmer model. Hence the need for a universal adjuster. The RUTBA model is a fine and smooth non-linear blades adjuster since both blades move with the rotating plate but the cutter blades at a higher rate than comb blade, which are affected by above factors.

The second universal trimmer blades adjuster with sliding block, SUTBA model, is straight forward but requires two movements, the levelling base plate and the sliding block. The loose comb blade (part 19) is placed on the levelling plate (part 22) while the slider bar (part 26) is moved enough by the slider wheel nut (part 27) above the leveling plate. The leveling plate is then adjusted up/down using the levelling wheel nut till the blades interface (part 33) just touches the slider interface (part 31) leaving it free to move. Place cutter blade on the comb blade and adjust the slider bar to the desired clearance and tighten screws of the cutter blade's guide.

Note that a small window facing the blades end can be cut to the slider bar to see through the clearance using a magnifier or zoomed mobile camera, or rely on the markers. These markers are micrometer scale that can be analogue or digital. These additions, small window, analogue or digital marker are optional subject to clients' needs.

The levelling and slider screws (parts 24 & 29) are either welded, glued or tightly locked (for example part 30 a small screw to lock slider screw) to the plate and bar so only their wheel nuts are free to rotate. These screws are fine pitch and their flat ends are surfaced with the plate and bar surfaces. The wheel nuts are marked with numbers so users know how much the plate and bar moves and make notes of these numbers for next adjustments.

The guides (parts 25 & 28) of levelling plate and slider bar are to ensure the straight movement of the plate and the bar with possibility to reduce levelling plate guides but not slider guides. These guides are smooth circular rods and tight holes, with rod tightly locked to their positions.

Most materials of the invention are made from metal such as iron that are frictionless and non-sticky like Aluminum. Hard plastic is an option but not desirable.

It is understood that the enclosed figures relating and describing the invention, the invention is not limited to the particular figures shown and described herein. The invention is customizable in many ways that various changes and modifications may be made without departing from the scope or spirit of this invention as defined by the following claims.

What is claimed is:

1. A universal trimmer blades adjuster comprising:
a base plate;
a holder with angle marks;
a holder;
a clamp holder;
a cutter clamp rod;
a clamps wing screw;
an upper cutter clamp;
a top spring;
a lower spring;
a rotating plate;
a rotating plate wing screw;
a comb clamp rod;
a comb lower clamp;
a set of screws;
a cutter blade; and
a comb blade;
wherein the cutter clamp rod is affixed to the upper cutter clamp;
wherein the top spring is attached to the upper cutter clamp configured to push the cutter blade towards the rotating plate; and
wherein the lower spring is attached to the comb lower clamp configured to push the comb blade towards the rotating plate.

2. The universal trimmer blades adjuster of claim 1, wherein the adjuster is configured with an angle variation-based design with the rotating plate with respect to the base plate resulting in a non-linear smooth adjustment of the angle to manipulate a displacement of the cutter blade and a displacement of the comb blade.

* * * * *